US009725265B2

(12) United States Patent
Hashimoto et al.

(10) Patent No.: US 9,725,265 B2
(45) Date of Patent: Aug. 8, 2017

(54) SHEET FEEDING DEVICE, IMAGE FORMING APPARATUS, AND IMAGE FORMING SYSTEM

(71) Applicants: Masato Hashimoto, Kanagawa (JP); Takashi Fukumoto, Kanagawa (JP); Hideaki Takahashi, Kanagawa (JP); Hisayoshi Sugawara, Kanagawa (JP); Munehisa Fuda, Kanagawa (JP); Yasuo Niikura, Kanagawa (JP); Masaki Ishizaki, Kanagawa (JP); Kiyotake Nakamura, Kanagawa (JP); Hidetoshi Kojima, Kanagawa (JP); Toshihiro Okutsu, Kanagawa (JP); Kazunori Konno, Kanagawa (JP); Tatsuya Sugawara, Kanagawa (JP); Kohjiroh Haga, Kanagawa (JP)

(72) Inventors: Masato Hashimoto, Kanagawa (JP); Takashi Fukumoto, Kanagawa (JP); Hideaki Takahashi, Kanagawa (JP); Hisayoshi Sugawara, Kanagawa (JP); Munehisa Fuda, Kanagawa (JP); Yasuo Niikura, Kanagawa (JP); Masaki Ishizaki, Kanagawa (JP); Kiyotake Nakamura, Kanagawa (JP); Hidetoshi Kojima, Kanagawa (JP); Toshihiro Okutsu, Kanagawa (JP); Kazunori Konno, Kanagawa (JP); Tatsuya Sugawara, Kanagawa (JP); Kohjiroh Haga, Kanagawa (JP)

(73) Assignee: RICOH COMPANY, LIMITED, Tokyo (JP)

( * ) Notice: Subject to any disclaimer, the term of this patent is extended or adjusted under 35 U.S.C. 154(b) by 0 days.

(21) Appl. No.: 14/873,280

(22) Filed: Oct. 2, 2015

(65) Prior Publication Data

US 2016/0107853 A1 Apr. 21, 2016

(30) Foreign Application Priority Data

Oct. 15, 2014 (JP) ..... 2014-211269

(51) Int. Cl.
*B65H 1/14* (2006.01)
*B65H 3/54* (2006.01)
(Continued)

(52) U.S. Cl.
CPC ..... *B65H 3/54* (2013.01); *B65H 1/14* (2013.01); *B65H 3/128* (2013.01); *B65H 3/48* (2013.01);
(Continued)

(58) Field of Classification Search
CPC ..... B65H 1/14; B65H 1/263; B65H 3/128; B65H 3/48; B65H 3/50; B65H 2405/11425; B65H 2511/10; B65H 2511/12
(Continued)

(56) References Cited

U.S. PATENT DOCUMENTS 7,677,553 B2 3/2010 Ikeda
8,191,892 B2 6/2012 Fuda et al.
(Continued)

FOREIGN PATENT DOCUMENTS

EP 1820760 A1 8/2007
JP 2010-058917 3/2010
(Continued)

OTHER PUBLICATIONS

Extended European Search Report dated Apr. 5, 2016.

*Primary Examiner* — Jeremy R Severson
(74) *Attorney, Agent, or Firm* — Harness, Dickey & Pierce, P.L.C.

(57) ABSTRACT

Provided are a floating restricting member restricting the floating position of a bundle of sheets; and a holding
(Continued)

mechanism holding the floating restricting member relative to a side fence. The floating restricting member includes a sheet contact section being brought into contact with the sheets from above; and a sheet-floating restricting section restricting the floating position of the floating sheet that is floated while air is blown thereto. The holding mechanism sets the floating restricting member in the initial state where the sheet-floating restricting section restricts the floating position of the sheet, in the sheet-placing time retracted state where the sheets are pushed against the sheet contact section so that the floating restricting member is retracted, and in the sheet-ejecting time retracted state where, when the sheets are to be removed, the sheet is pushed against the sheet contact section from below so that the floating restricting member is retracted.

20 Claims, 7 Drawing Sheets

(51) Int. Cl.
*B65H 3/50* (2006.01)
*B65H 3/12* (2006.01)
*B65H 3/48* (2006.01)

(52) U.S. Cl.
CPC ..... *B65H 3/50* (2013.01); *B65H 2405/11425* (2013.01); *B65H 2511/12* (2013.01); *B65H 2801/06* (2013.01)

(58) Field of Classification Search
USPC ..... 271/171
See application file for complete search history.

(56) References Cited

U.S. PATENT DOCUMENTS

| | | | | |
|---|---|---|---|---|
| 8,870,179 | B2 * | 10/2014 | Shiraishi ..... | B65H 1/14 271/104 |
| 8,955,835 | B2 | 2/2015 | Satoh et al. | |
| 2008/0088078 | A1 | 4/2008 | Kushida | |
| 2008/0297580 | A1 | 12/2008 | Fukumoto et al. | |
| 2009/0014948 | A1 | 1/2009 | Takahashi | |
| 2011/0148027 | A1 | 6/2011 | Fuda | |
| 2011/0187042 | A1 | 8/2011 | Fuda | |
| 2011/0187044 | A1 | 8/2011 | Utagawa et al. | |
| 2011/0193284 | A1 | 8/2011 | Fuda | |
| 2011/0221119 | A1 | 9/2011 | Fuda | |
| 2012/0133092 | A1 | 5/2012 | Fuda et al. | |
| 2012/0313315 | A1 | 12/2012 | Fukumoto et al. | |
| 2013/0062827 | A1 | 3/2013 | Fuda | |
| 2013/0087967 | A1 | 4/2013 | Fuda et al. | |
| 2013/0106045 | A1 | 5/2013 | Okutsu et al. | |
| 2013/0334764 | A1 | 12/2013 | Fuda | |
| 2014/0339759 | A1 | 11/2014 | Takahashi et al. | |
| 2014/0339761 | A1 | 11/2014 | Oikawa et al. | |
| 2014/0346728 | A1 | 11/2014 | Fuda et al. | |
| 2015/0166280 | A1 | 6/2015 | Hino et al. | |
| 2015/0225191 | A1 | 8/2015 | Niikura et al. | |

FOREIGN PATENT DOCUMENTS

| | | |
|---|---|---|
| JP | 4677354 | 2/2011 |
| JP | 2011-068455 | 4/2011 |

* cited by examiner

SHEET FEEDING DEVICE, IMAGE FORMING APPARATUS, AND IMAGE FORMING SYSTEM

CROSS-REFERENCE TO RELATED APPLICATIONS

The present application claims priority to and incorporates by reference the entire contents of Japanese Patent Application No. 2014-211269 filed in Japan on Oct. 15, 2014.

BACKGROUND OF THE INVENTION

1. Field of the Invention

The present invention relates to a sheet feeding device, an image forming apparatus, and an image forming system.

2. Description of the Related Art

High productivity and superior stability are required for sheet feeding devices that are used in image forming apparatuses, such as copiers or printers, and that feed sheets to an image forming unit, and a friction separation method using a sheet feeding roller or an air separation method using air blowing is used. Among them, in a sheet feeding device that makes a separation due to air blowing, separation air is blown to a sheet that is suctioned onto a conveyance belt due to a negative pressure so that the second and subsequent sheets are separated, whereby the sheets are conveyed one by one.

Furthermore, some of the sheet feeding devices, which make a separation due to air blowing, are provided with a floating restricting member that restricts the lifting position of the sheet that is floated due to blowing of separation air, thereby restricting lifting of the sheet.

Japanese Patent No. 4677354 discloses a sheet delivering device that is provided with a floating restricting member to release the suctioned sheet while preventing air from escaping, the provided floating restricting member pushes both ends of a sheet with respect to a width direction such that the central part of the sheet with respect to the width direction is floated over the entire area in a sheet feeding direction due to air that is blown by an air blowing unit and an auxiliary air blowing unit, and the floating restricting member is attached such that it is rotatable in a vertical direction.

However, in conventional sheet feeding devices, the floating restricting member makes it difficult to perform operations to place sheets or remove sheets. Furthermore, although the floating restricting member is rotatable as described in Japanese Patent No. 4677354, the floating restricting member is always ejected and it interferes with sheets being moved in or out. Furthermore, with the floating restricting member, sheets cannot be placed within the rotation range, especially, the downward rotation range; therefore, there is a limitation on the load capacity of sheets such that the upper end of the loaded sheets does not fall within the downward rotation range of the floating restricting member. Moreover, when sheets are placed, the floating restricting member is brought into contact with the sheets, the hands, or the like; therefore, the working space is limited, and the sheets or the device is sometimes damaged depending on the direction or the strength of the contact.

In view of the above-mentioned conventional problem, there is a need to provide a sheet feeding device in which the provided floating restricting member does not interfere with an operation to place sheets or an operation to remove them, does not cause any damage to the device or sheets, or does not limit the load capacity of sheets.

SUMMARY OF THE INVENTION

It is an object of the present invention to at least partially solve the problems in the conventional technology.

According to the present invention, there is provided a sheet feeding device comprising: a bottom plate on which a sheet is placed; a pair of sheet-position adjusting members that are provided on both ends of the bottom plate with respect to a sheet width direction that intersects with a sheet conveying direction and that are opposed to each other so as to adjust a position of the sheet in the sheet width direction; and an air blowing unit that blows air to the sheet that is placed on the bottom plate so as to float the sheet, wherein each of the sheet-position adjusting members includes a floating restricting member that is provided such that the floating restricting member protrudes toward a middle of the sheet-position adjusting members and that pushes down the sheet that is placed on the bottom plate so as to restrict a floating position of the sheet; and a holding mechanism that movably holds the floating restricting member relative to the sheet-position adjusting member, the floating restricting member includes a sheet contact section that is brought into contact with the sheet when the sheet is pushed from above; and a sheet-floating restricting section that is provided adjacent to the sheet contact section such that the sheet-floating restricting section and the sheet contact section make a predetermined angle at an edge section and that is brought into contact with the sheet that is floated while the air is blown thereto, thereby restricting a floating position of the sheet, and the holding mechanism movably holds the floating restricting member in an initial state where the edge section protrudes toward a middle of the sheet-position adjusting members so that the sheet-floating restricting section restricts the floating position of the sheet and the sheet contact section is provided in such an attitude that the sheet contact section moves downward while moving inward, and in a sheet-placing time retracted state where, when the sheet to be supplied is pushed against the sheet contact section from above in the initial state, the floating restricting member is moved along a horizontal plane that intersects with the sheet conveying direction while the edge section is rotated downward so that the floating restricting member is moved outside the sheet-position adjusting member.

The present invention also provides an image forming apparatus comprising: the above-described sheet feeding device; and an image forming unit that forms an image on the sheet that is conveyed by the sheet feeding device.

The present invention also provides an image forming system comprising: the above-described sheet feeding device; and an image forming apparatus that forms an image on the sheet that is conveyed by the sheet feeding device.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

An explanation is given of a sheet feeding device, an image forming apparatus, and an image forming system according to an embodiment of the present invention.

First Embodiment

Figure 1:
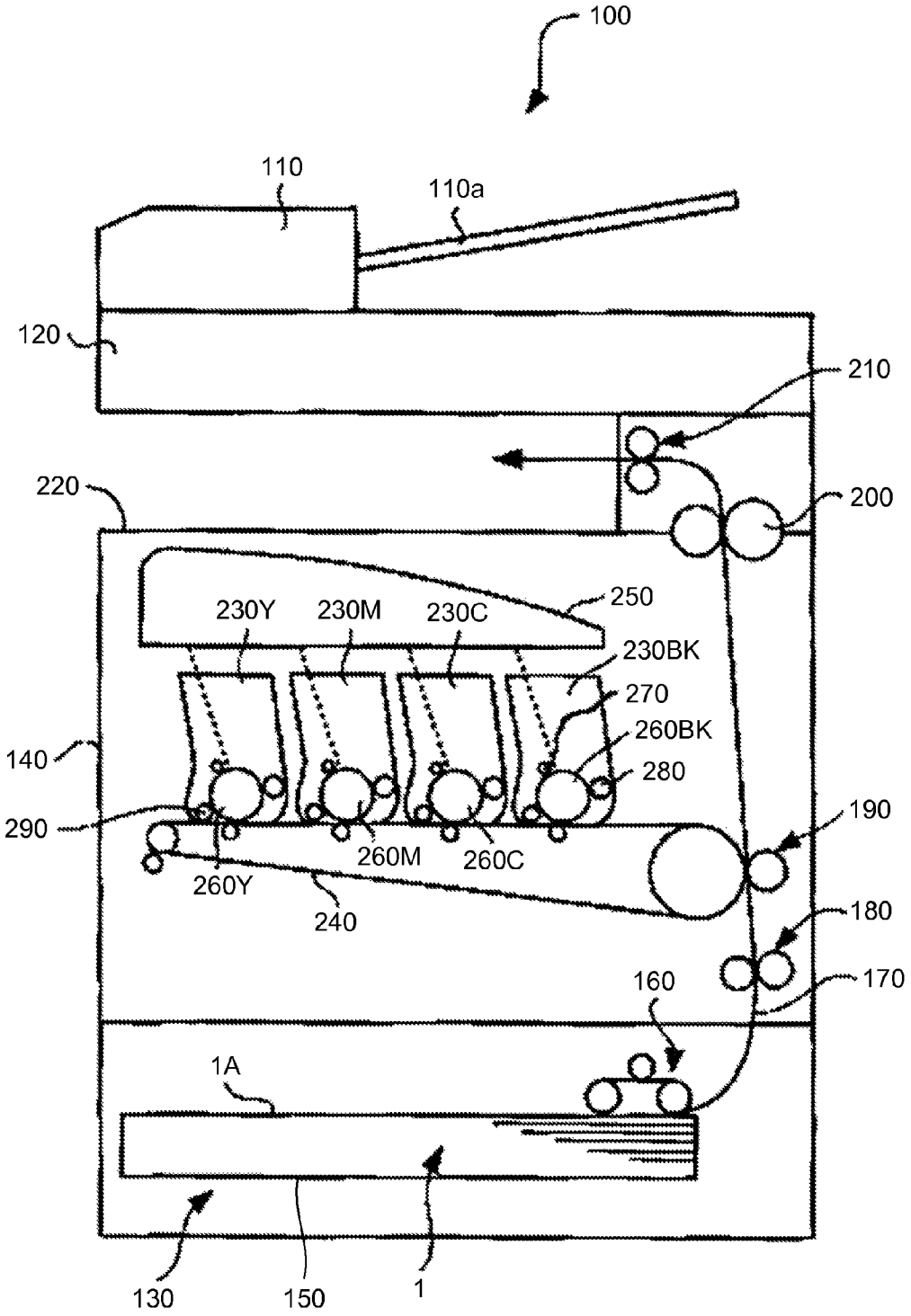
FIG. 1 is a schematic configuration diagram that illustrates an image forming apparatus that includes a sheet feeding device according to an embodiment of the present invention.

An explanation is given below of an image forming apparatus according to an embodiment of the present invention. FIG. 1 is a schematic configuration diagram that illustrates the image forming apparatus that includes a sheet feeding device according to the embodiment of the present invention. Furthermore, the embodiment of the present invention is intended for not only the illustrated image forming apparatus but also various apparatuses that have the functions of, for example, a copier, a facsimile machine, or a multifunction peripheral that has a copying function, a fax function, or the like, and that perform image forming. Furthermore, the present invention can be intended for a large-volume sheet feeding device that includes a sheet feeding device according to the present invention as a separate device from the image forming apparatus or for an image forming system that includes a post-processing device that performs a folding operation or a binding operation.

As illustrated in FIG. 1, an image forming apparatus 100, which is a copier, includes an automatic document feeder 110, a document reading unit 120, a sheet feeding device 130, and an image forming unit 140. The automatic document feeder 110 separates a single document from the bundle of documents that is placed on a document tray 110*a* and automatically feeds a sheet to a contact glass on the document reading unit 120. The document reading unit 120 reads a document that is conveyed to the contact glass by the automatic document feeder 110. A bundle of sheets 1 is placed in the sheet feeding device 130, and a top sheet 1A is separated from the bundle of sheets 1 by a sheet separating and feeding device 160 and is conveyed to the image forming unit 140. The image forming unit 140 serves as a unit for forming an image, and it forms an image read by the document reading unit 120 on a sheet that is conveyed from the sheet feeding device 130.

The sheet feeding device 130 includes a sheet feeding cassette 150 that stores the bundle of sheets 1 that includes multiple sheets and includes the sheet separating and feeding device 160 that separates the top sheet 1A from the bundle of sheets 1 in the sheet feeding cassette 150 and conveys it. The sheet separating and feeding device 160 includes an air blowing unit that is described later, and it looses the bundle of sheets 1 so as to separate and convey the top sheet 1A with accuracy.

After the sheet 1A is separated and fed by the sheet separating and feeding device 160, it is conveyed through a conveyance path 170, i.e., it is conveyed through the conveyance path 170 by a pair of conveyance rollers 180. Furthermore, a toner image is formed by the image forming unit 140, the toner image is transferred onto the sheet 1A by a transfer roller 190 and is then thermally transferred by a fixing device 200, and the sheet 1A is ejected into a paper ejection tray 220 by a pair of paper ejection rollers 210.

The image forming unit 140 includes four image forming units 230 (230Y (yellow), 230C (cyan), 230M (magenta), and 230BK (black)), an intermediate transfer belt 240 that is a transfer belt, and an exposure device 250.

The exposure device 250 converts the image data that is input from an external device, such as a personal computer, and that is subjected to color separation and the image data on a document that is read by the document reading unit 120 into light-source driving signals. Then, a semiconductor laser in each laser light-source unit is accordingly driven so that a light beam is emitted.

The image forming units 230Y, 230C, 230M, and 230BK form images (toner images) of different colors. The image forming units 230Y, 230C, 230M, and 230BK include photoconductors 260 (260Y, 260C, 260M, and 260BK) that are image bearers that are driven and rotated in a clockwise direction and include a charging unit 270, a developing unit 280, a cleaning unit 290, or the like, that are arranged around the photoconductor 260.

The photoconductor 260 is formed into a cylindrical shape, and it is driven and rotated by a driving source (not shown). A photoconductive layer is provided on the outer circumference surface of the photoconductor 260, and a spot on the outer circumference surface of the photoconductor 260 is irradiated with a light beam that is emitted by the exposure device 250 and that is indicated by a dashed line, whereby the electrostatic latent image that corresponds to the image information is written on the outer circumference surface of the photoconductor 260.

The charging unit 270 uniformly charges the outer circumference surface of the photoconductor 260, and it uses a method with which it is brought into contact with the photoconductor 260. Toner is fed to the photoconductor 260 by the developing unit 280, and the fed toner adheres to the electrostatic latent image that is written on the outer circumference surface of the photoconductor 260 so that the electrostatic latent image on the photoconductor 260 is developed as a toner image. In this example, the developing unit 280 uses a method with which it is not brought into contact with the photoconductor 260.

The cleaning unit 290 removes the residual toner that adheres to the outer circumference surface of the photoconductor 260. In this example, the cleaning unit 290 uses a brush contact method with which a brush is brought into contact with the outer circumference surface of the photoconductor 260.

The intermediate transfer belt 240 includes an endless belt that is made of a resin film or rubber as a base. A toner image formed on the photoconductor 260 is transferred onto the intermediate transfer belt 240, and the toner image transferred onto the intermediate transfer belt 240 is transferred onto a sheet by the transfer roller 190.

Figure 2:
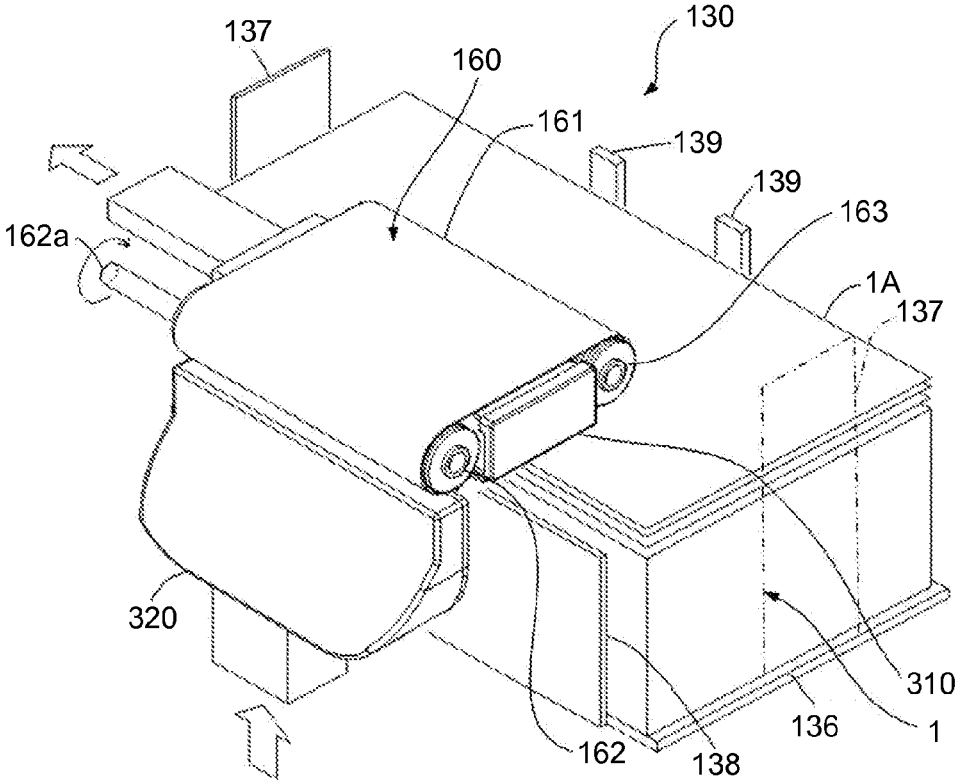
FIG. 2 is a perspective view that illustrates the sheet feeding device.
Figure 3:
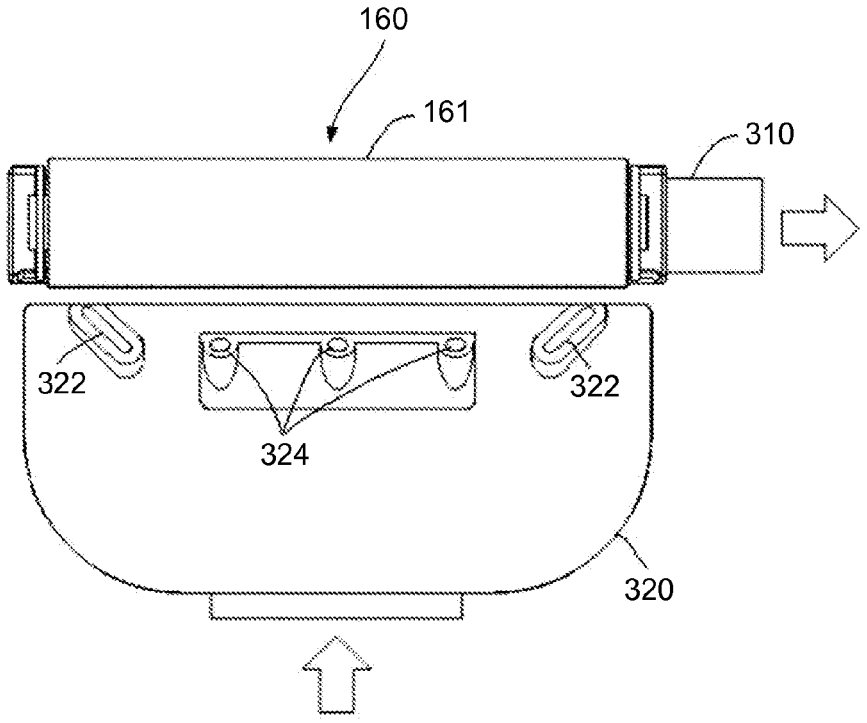
FIG. 3 is a front view that illustrates an air-ejection nozzle unit of the sheet feeding device.
Figure 4:
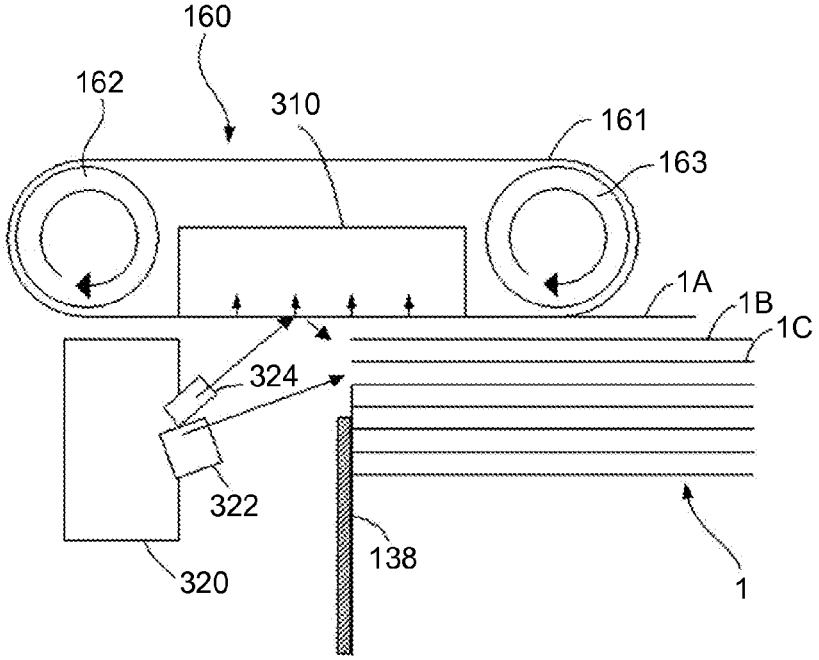
FIG. 4 is a schematic diagram that illustrates sheet separation by the sheet feeding device.

Next, an explanation is given of the sheet feeding device 130. FIG. 2 is a perspective view that illustrates the sheet feeding device, FIG. 3 is a front view that illustrates an air-ejection nozzle unit of the sheet feeding device, and FIG. 4 is a schematic diagram that illustrates sheet separation by the sheet feeding device. In the sheet feeding device 130, the bundle of sheets 1 is placed on a sheet feeding table 136 that is a bottom plate, and the sheet feeding table 136 has a lifting and lowering function. The top sheet 1A is separated from the bundle of sheets 1 on the sheet feeding table 136 by the sheet separating and feeding device 160, and it is then conveyed.

Furthermore, the sheet feeding device 130 is provided with side fences 137, 137 that are a pair of sheet-position adjusting members, a front-edge guide plate 138, and an end fence 139. The side fences 137, 137 are located on both ends of the sheet feeding table 136 with respect to the sheet width direction. They set the position of the placed bundle of sheets 1 in the sheet width direction that intersects with (is perpendicular to) the conveying direction. The front-edge guide plate 138 sets the position of the front edge of the bundle of sheets 1 in the length direction that corresponds to the sheet feeding direction. Similarly, the end fence 139 sets the position in a back direction.

The sheet separating and feeding device 160 includes a drive roller 162, a driven roller 163, a conveyance belt 161, and a negative-pressure air chamber 310. The drive roller 162 is driven and rotated by a drive shaft 162*a*, and the driven roller 163 is rotated in accordance with the conveyance belt 161 that is rotated due to the driving of the drive roller 162. The conveyance belt 161 is an endless belt member on which a large number of vacuum holes are formed such that they communicate with the negative-pressure air chamber 310. The negative-pressure air chamber 310 maintains its negative pressure state while it is vacuumed from outside, and it suctions the top sheet 1*a* through the vacuum holes of the conveyance belt 161.

An air chamber 320, which includes an air blowing unit, is provided at the position that is opposed to the front edge of the placed bundle of sheets 1. Compressed air is supplied to the air chamber 320 from outside and is stored therein. As illustrated in FIG. 3, the air chamber 320 is provided with a floating nozzle 322 and a separating nozzle 324. Furthermore, as well as the floating nozzle 322 and the separating nozzle 324, the sheet feeding device 130 includes, as the air blowing unit, side floating nozzles 330 that are provided on the side fences 137, 137 and that blow air to the side of the bundle of sheets 1 (see FIG. 5).

As illustrated in FIG. 4, the floating nozzle 322 blows flotation air toward the front edge of the bundle of sheets 1 to float a sheet from the bundle of sheets 1, thereby separating the sheets. Furthermore, if the blowing air is hot air, the effect for dehumidifying a recording sheet is added, whereby sheets can be separated in a more effective manner. Furthermore, the separating nozzle 324 blows air toward the conveyance belt 161 so that second and subsequent sheets 1B, 1C, . . . , which adhere to the top sheet 1A, are pushed downward and are separated due to the air that is reflected by the conveyance belt 161.

Figure 5:
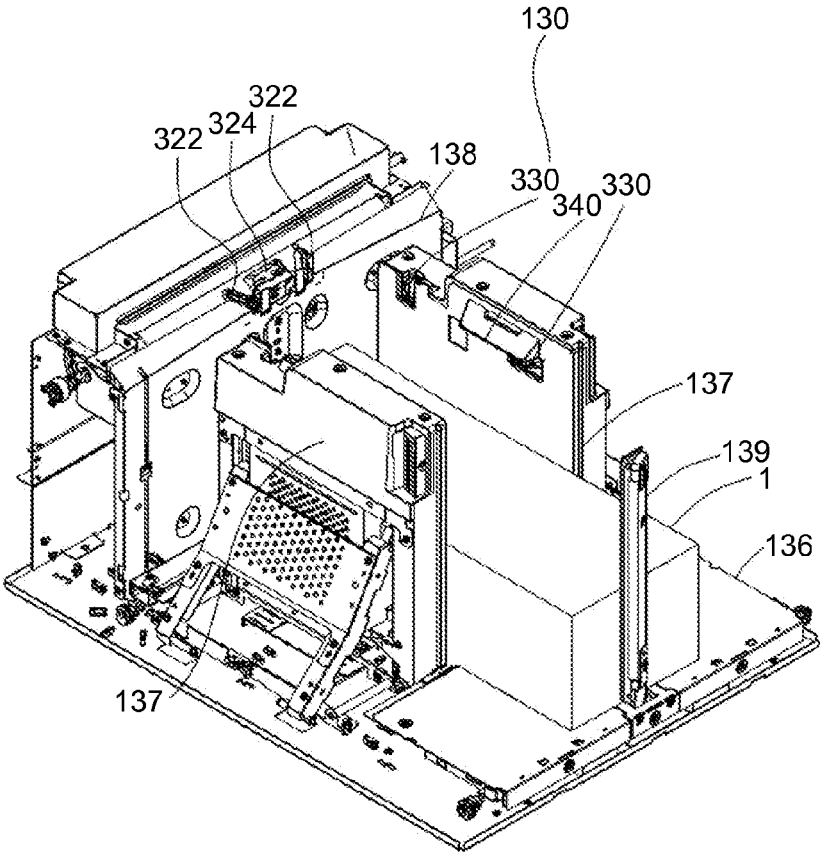
FIG. 5 is a perspective view that illustrates the sheet feeding device.
Figure 6:
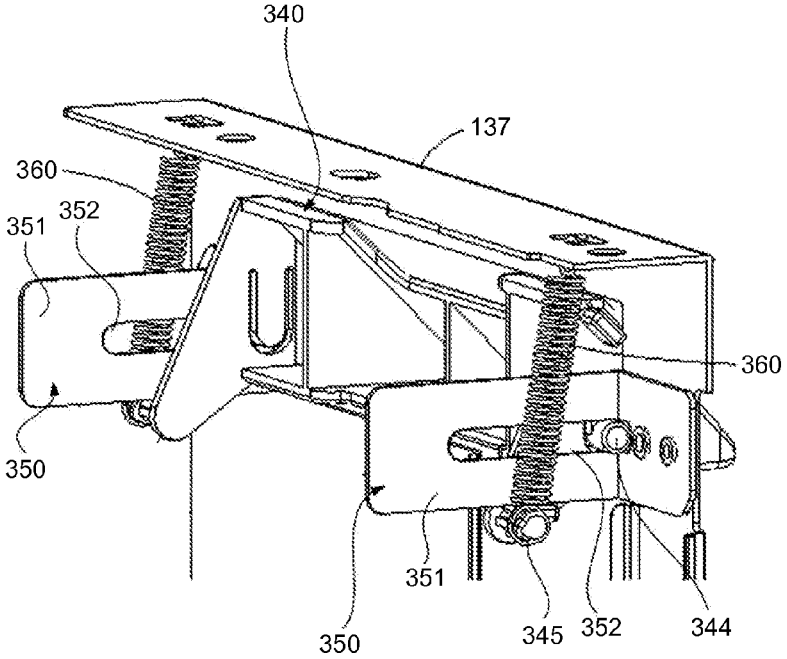
FIG. 6 is an enlarged perspective view that illustrates the floating restricting member of the sheet feeding device.

Each of the side fences 137, 137 of the sheet feeding device 130 according to the embodiment is provided with a floating restricting member 340 that restricts the floating position of the sheet 1A. The floating restricting member 340 is explained below. FIG. 5 is a perspective view that illustrates the floating restricting member of the sheet feeding device, and FIG. 6 is an enlarged perspective view that illustrates the floating restricting member of the sheet feeding device. In the sheet feeding device 130, each of the side fences 137, 137 is provided with the above-described side floating nozzle 330 and the above-described floating restricting member 340. The side floating nozzle 330 blows air to the bundle of sheets 1 so as to separate the bundle of sheets 1 and float sheets.

The floating restricting member 340 protrudes toward the middle of the side fences 137, 137 to prevent the floating sheet from rising too much due to the flotation air that is blown by the floating nozzle 322 and the side floating nozzle 330. The force for pressing a sheet by the floating restricting member 340 needs to be larger than the force for floating a sheet. Furthermore, the floating restricting member 340 restricts the top position of the upper surface of the bundle of sheets 1, thereby preventing sheet flapping. Thus, it is possible to improve the effect of separation by blowing air strongly.

Due to the flotation air from the floating nozzle 322 of the air chamber 320, the bundle of sheets 1 is separated so that the top sheet 1A and the second and subsequent sheets 1B, 1C, . . . , are floated. Among the floating sheets, only the top sheet 1A or the top sheet 1A and the second and subsequent sheets 1B, 1C, . . . , are suctioned onto the conveyance belt 161 by the negative-pressure air chamber 310. Then, the separation air, which comes from the separating nozzle 324 and is reflected by the conveyance belt 161, is blown such that it is pushed downward so that the second and subsequent sheets 1B, 1C, . . . , are separated from the top sheet 1A, and only the top sheet 1A is conveyed by the conveyance belt 161.

Figure 7A:
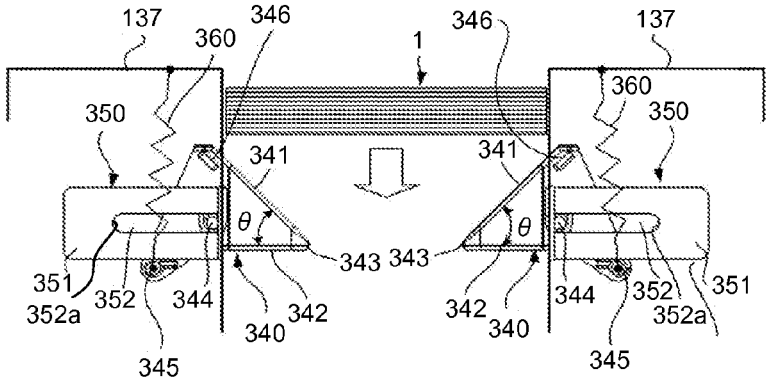
FIGS. 7A and 7B are cross-sectional views that illustrate operations of the floating restricting member when sheets are placed in the sheet feeding device.
Figure 7B:
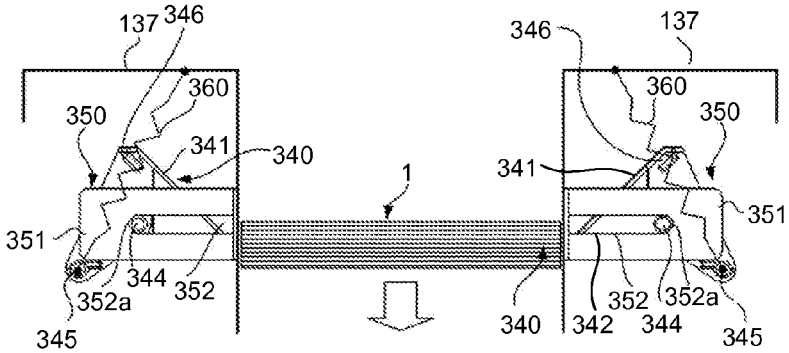

FIG. 6 is an enlarged perspective view that illustrates the floating restricting member of the sheet feeding device, and FIGS. 7A and 7B are cross-sectional views that illustrate operations of the floating restricting member when the sheets are placed. The floating restricting members 340 are provided on the side fences 137, 137 via holding mechanisms 350. The floating restricting member 340 includes a sheet contact section 341 and a sheet-floating restricting section 342. The sheet contact section 341 and the sheet-floating restricting section 342 are located adjacent to each other such that they make a predetermined angle θ (see FIG. 7A) at an edge section 343. Furthermore, the floating restricting member 340 has a predetermined length in the sheet conveying direction, and pin members 344, 344 are provided at both ends thereof. The pin member 344 is provided at the area that is sandwiched between the sheet contact section 341 and the sheet-floating restricting section 342.

When the bundle of sheets 1 are placed in the sheet feeding device 130, the sheet contact section 341 is brought into contact with the side edge of the bundle of sheets 1 that are pushed from above. Furthermore, the sheet-floating restricting section 342 is brought into contact with the top sheet 1A that is floated due to blowing air. The pin members 344, 344 constitute the holding mechanisms 350 together with guide members 351 that are provided in the side fences 137, and they are guide shafts while the floating restricting members 340 are moved.

The floating restricting member 340 is provided such that it is movable to the predetermined initial state (FIG. 7A), the sheet-placing time retracted state (FIG. 7B), and the sheet-ejecting time retracted state (FIG. 8C) in accordance with the guide of the holding mechanism 350.

The guide members 351 are provided outside the side fences 137, 137 along the sheet width direction, and they are configured as plate-like members on which a slit section 352 is formed. The slit section 352 is formed on a horizontal plane in the sheet width direction, and the pin member 344 of the floating restricting member 340 is slidably and rotatably provided in the slit section 352. Furthermore, the pin member 344 is brought into contact with an outer-side inner edge section 352*a* of the slit section 352 and is stopped, whereby the guide member 351 serves as a horizontal-movement restricting member that restricts the movement range of the holding mechanism 350 in a horizontal direction.

A spring 360, which is an elastic member, is provided in the holding mechanism 350. The springs 360 connect the upper sections of the side fences 137, 137 with spring attachment pins 345 of the floating restricting members 340. The spring attachment pin 345 is provided on the opposite side of the edge section 343 with the pin member 344 interposed therebetween and is provided on the side of the sheet-floating restricting section 342. The spring attachment pin 345 is brought into contact with the guide member 351 when the floating restricting member 340 is rotated with the edge section 343 facing downward, thereby also serving as a rotation restricting member that restricts the range of the rotary action of the floating restricting member 340. Furthermore, the floating restricting member 340 includes a projection section 346 that serves as a rotation control member that is provided near the upper end of the sheet contact section 341 and that is brought into contact with the guide member 351 so as to restrict the movement range of the floating restricting member 340 in the rotation direction.

The spring 360 is provided in a stretched state, and it biases the floating restricting member 340 that is rotated around the pin member 344 such that the edge section 343 is moved upward. Thus, loads are applied to prevent the rotation due to the floating sheet 1A. Furthermore, the spring 360 biases the floating restricting member 340 such that the pin member 344 moves inward along the slit section 352. Moreover, the spring 360 returns the floating restricting member 340 to the initial state in a state where the floating restricting member 340 is not in contact with the bundle of sheets 1 or the sheet 1A. In this example, the single spring 360 is provided for each of the floating restricting members 340; however, multiple elastic members, such as springs, may be provided so that the floating restricting member 340 is operated in the same manner.

Next, an explanation is given of an operation of the floating restricting member 340 and various types of states. First, an explanation is given of the operation of the floating restricting member 340 when a bundle of sheets is placed. FIGS. 7A and 7B are cross-sectional views that illustrate an operation of the floating restricting member when sheets are placed in the sheet feeding device. In the initial state where the bundle of sheets 1 is not placed in the sheet feeding device 130, the state of the floating restricting member 340 is set by the holding mechanism 350 and the spring 360 such that the edge section 343 protrudes inward from the side fence 137 to the maximum degree, as illustrated in FIG. 7A. At this point, the sheet-floating restricting section 342 protrudes vertically from inside the side fence 137. Furthermore, the attitude of the sheet contact section 341 is set such that it moves downward while moving inward.

When the bundle of sheets 1 is supplied to the sheet feeding device 130 from above, both sheet-width ends of the bundle of sheets 1 are brought into contact with the sheet contact section 341 of the floating restricting member 340 from above. Thus, the floating restricting member 340 receives an outward force in the horizontal direction due to a component force of the tilt of the sheet contact section 341 against the stretching force of the spring 360. Due to this force, the pin member 344 moves outward within the guide member 351, comes in contact with the outer-side inner edge section 352*a*, and then stops. In this state, the floating restricting member 340 moves in the horizontal direction without rotating and completely enters the inner side of the side fence 137, as illustrated in FIG. 7B (the sheet-placing time retracted state). Furthermore, the floating restricting member 340 enters the state where it does not protrude from the inner wall surface of the side fence 137, whereby the bundle of sheets 1 can be stacked on the sheet feeding table 136 to the maximum height without receiving any restrictions due to the movement of the floating restricting member 340.

Conversely, if the floating restricting member is simply rotated downward, the trajectory of the downwardly retracting action of the floating restricting member causes interference; therefore, the load capacity for the bundle of sheets 1 is further decreased by the trajectory of the action below the level of the floating restricting member.

Figure 8A:
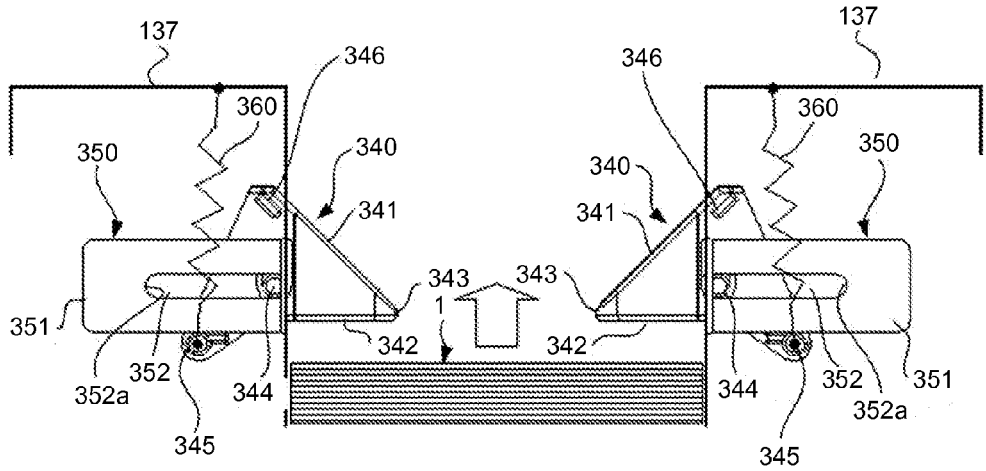
FIGS. 8A to 8C are cross-sectional views that illustrate operations of the floating restricting member when sheets are removed from the sheet feeding device.

Furthermore, after the bundle of sheets 1 is completely placed, the floating restricting member 340 is moved by the spring 360 and is returned to the initial state that is illustrated in FIG. 8A. In this state, it is possible to restrict the position of a sheet that is floated due to air ejection.

Figure 8B:
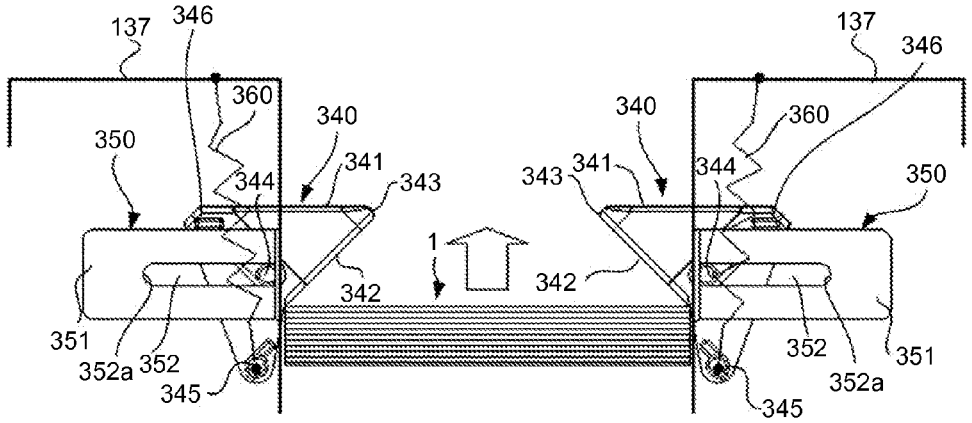
Figure 8C:
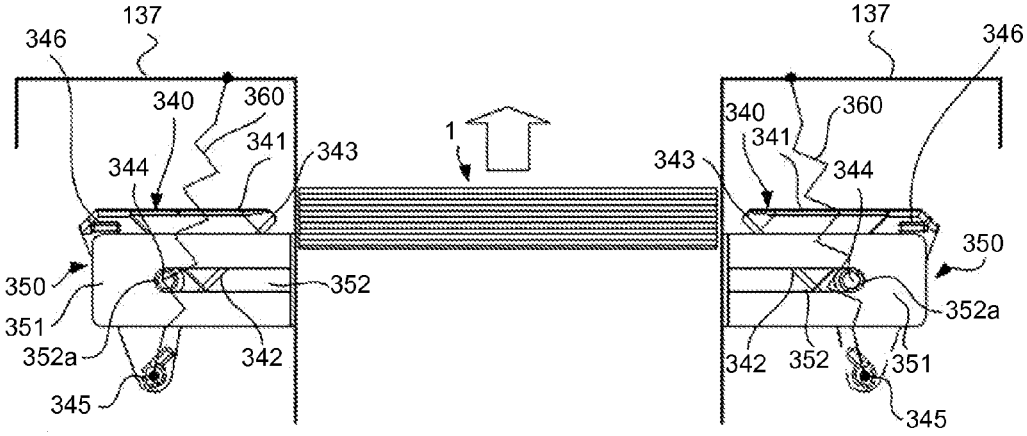

Next, an explanation is given of an operation of the floating restricting member 340 when the bundle of sheets 1 is removed from the sheet feeding device 130. FIGS. 8A to 8C are cross-sectional views that illustrate operations of the floating restricting member when sheets are removed from the sheet feeding device. In the initial state that is illustrated in FIG. 8A, when the bundle of sheets 1 is to be removed from the sheet feeding device 130, the bundle of sheets 1 is brought into contact with the floating restricting member 340 from below and is pressed against it (FIG. 8B). Then, both ends of the bundle of sheets 1 are brought into contact with the sheet-floating restricting section 342 of the floating restricting member 340, and the floating restricting members 340 are pushed upward by both sheet-width ends of the bundle of sheets 1 and are moved outward while being rotated (FIGS. 8B and 8C). At this point, the floating restricting member 340 is rotated until the projection section 346 is brought into contact with the guide member 351 (FIG. 8B). Then, it is slid due to the outward component force by the tilted sheet-floating restricting section 342 and is moved until the pin member 344 is brought into contact with the outer-side inner edge section 352*a* of the slit section 352 and is stopped (FIG. 8C). In this state, the floating restricting member 340 enters the side fence 137 so that it enters a state where it is not in contact with the bundle of sheets 1.

After the bundle of sheets 1 is completely removed, the floating restricting member 340 is moved by the spring 360 so as to return to the initial position in a sliding direction. Then, when the center line of the spring 360 passes through the pin member 344 of the floating restricting member 340, a rotative force is generated so that the floating restricting member 340 is rotated and is set in the initial state (FIG. 8A).

According to the present embodiment, the fixing position of the spring 360 on the floating restricting member 340 is located in the spring attachment pin 345, i.e., it is set in a position that is located away from the pin member 344 that is the rotation center of the floating restricting member 340.

Therefore, a spring in a sliding direction and in a rotation direction can be common; thus, downsizing is possible.

With the above-described sheet feeding device according to the present embodiment, it is possible to prevent the floating restricting member 340 from interfering with an operation to place a bundle of sheets or an operation to remove it or to prevent the sheet feeding device or the sheets from being damaged when the bundle of sheets 1 and the floating restricting member 340 are brought into contact with each other. Furthermore, as the floating restricting member 340 is moved, there is no limitation on the load capacity for sheets.

Second Embodiment

Figure 9A:
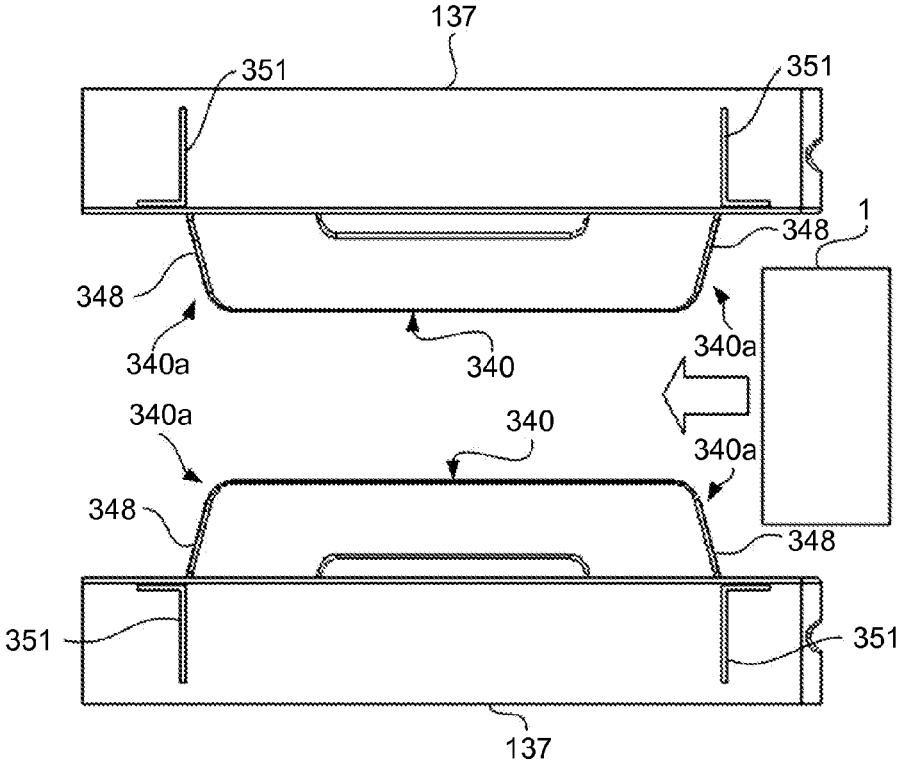
FIGS. 9A and 9B are plan views that illustrate operations of the floating restricting member of the sheet feeding device according to a second embodiment of the present invention.
Figure 9B:
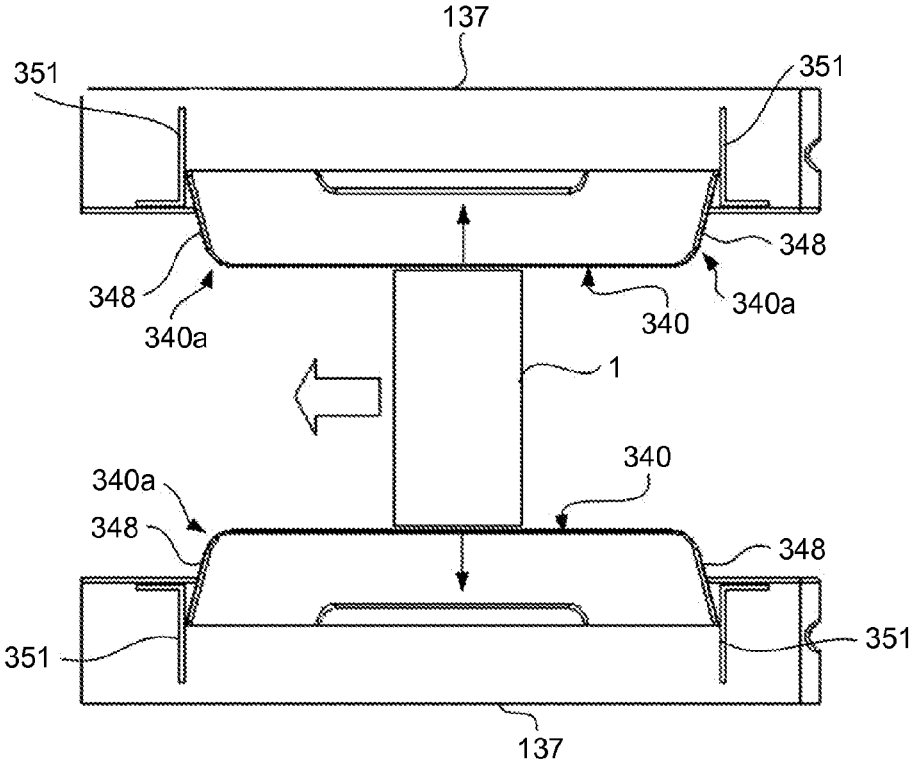

Next, an explanation is given of a sheet feeding device according to a second embodiment. FIGS. 9A and 9B are plan views that illustrate operations of the floating restricting member of the sheet feeding device according to the second embodiment of the present invention. Here, FIG. 9A illustrates the initial position of the floating restricting member 340 when the bundle of sheets 1 is placed from the side, and FIG. 9B illustrates the state where the floating restricting member 340 is retracted when the bundle of sheets 1 is placed from the side.

In the sheet feeding device according to the second embodiment, tilted sections 348, 348 are formed on front and rear edge sections 340*a*, 340*a* of the floating restricting member 340 with respect to the sheet conveying direction. When the bundle of sheets 1 is placed from the side, the bundle of sheets 1 is brought into contact with the tilted sections 348, 348, and the floating restricting member 340 is slid and retracted into the side fence 137 due to the component force of the tilted section 348 against the spring 360. At this point, the pin members 344, 344 are slid within the slit sections 352, 352 of the guide members 351, 351. Then, after the bundle of sheets 1 is completely placed, the floating restricting member 340 is returned to the initial position by the spring 360.

According to the present embodiment, in a case where the bundle of sheets 1 is placed in a direction that conforms with the conveying direction, the floating restricting member 340 is retracted into the side fence 137, whereby the bundle of sheets 1 can be easily placed without being damaged.

Third Embodiment

Figure 10:
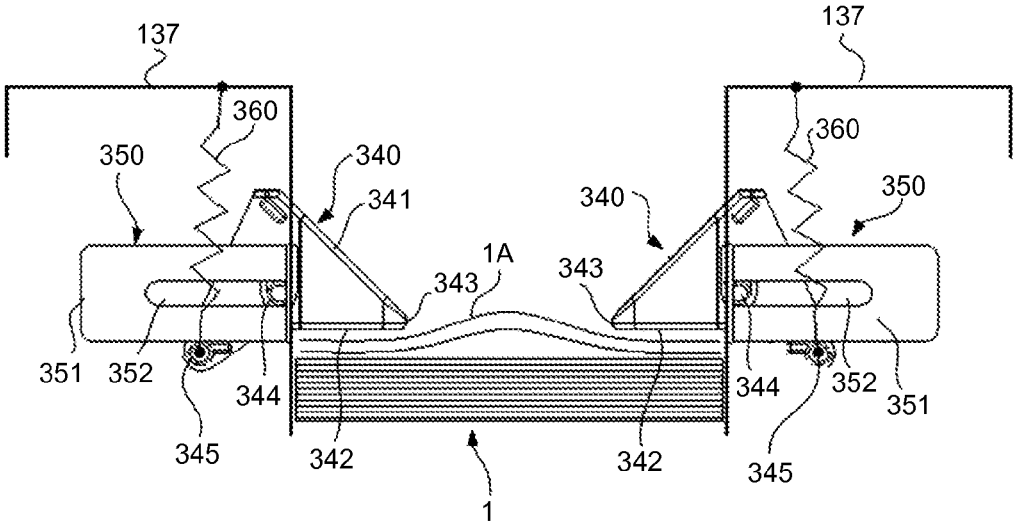
FIG. 10 is a cross-sectional view that illustrates the state of sheets when a bundle of sheets is placed in the sheet feeding device according to a third embodiment of the present invention.
Figure 11:
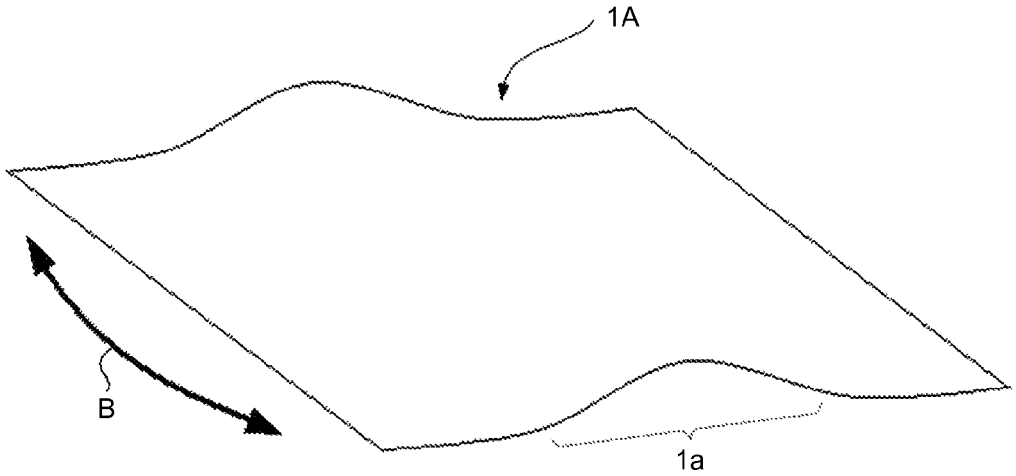
FIG. 11 is a perspective view that illustrates the state of a deformed sheet whose ends are pushed by the floating restricting members.

Next, an explanation is given of a sheet feeding device according to a third embodiment. FIG. 10 is a cross-sectional view that illustrates the state of sheets when the bundle of sheets is placed in the sheet feeding device according to the third embodiment of the present invention, and FIG. 11 is a perspective view that illustrates the state of a deformed sheet whose ends are pushed by the floating restricting members.

In the sheet feeding device according to the third embodiment, the floating restricting member 340 is moved relative to the bundle of sheets 1 in a vertical direction so that the floating restricting member 340 is brought into contact with the upper end of the bundle of sheets 1. In this example, the sheet feeding table 136 is lifted up so that the floating restricting member 340 is moved relative to the bundle of sheets 1. Furthermore, the floating restricting member 340 may be provided with a mechanism that moves the floating restricting member 340 in a vertical direction.

While the bundle of sheets 1 is placed, when the floating restricting member 340 is relatively pushed downward, both ends of the sheet 1A in the bundle of sheets 1, which is floated due to flotation air, are pressed by the floating restricting members 340. Therefore, as illustrated in FIG. 11, a central part 1*a* of the sheet 1A with respect to the width direction is formed into a curved shape with a convex in the top. As the sheet 1A is largely curved, the bending rigidity of the sheet 1A in the direction of the arrow B is increased.

Thus, according to the present embodiment, the occurrence of an irregular behavior of the sheet 1A due to air blowing is stabilized. This is highly effective in a case where the sheet 1A has a low bending rigidity, i.e., if the sheet 1A is a thin sheet, for example. However, it is necessary to take account of sheets with a high bending rigidity, as they originally have a high "stiffness", it is less effective to increase the bending rigidity and, as the load during conveyance of sheets is increased, adverse effects, such as a failure to feed sheets, sometimes occur.

According to the present embodiment, the floating restricting member 340 is brought into contact with the bundle of sheets 1 by adjusting the movement distance with respect to the bundle of sheets 1 in a vertical direction; thus, it is possible to apply a bending rigidity in accordance with the characteristics of sheets, and it is possible to handle thin sheets and thick sheets.

With the sheet feeding device according to the embodiments of the present invention, the floating restricting member does not interfere with an operation to place sheets or an operation to remove them, does not cause any damage to the device or sheets, or does not limit the load capacity of sheets.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. A sheet feeding device comprising:

a bottom plate on which a sheet is placed;

a pair of sheet-position adjusting members on both ends of the bottom plate with respect to a sheet width direction that intersects with a sheet conveying direction and that are opposed to each other so as to adjust a position of the sheet in the sheet width direction; and an air blowing unit configured to blow air to the sheet that is placed on the bottom plate so as to float the sheet, wherein each of the sheet-position adjusting members includes:

a floating restricting member configured to protrude toward a middle of the sheet-position adjusting members and configured to push down the sheet that is placed on the bottom plate so as to restrict a floating position of the sheet; and a holding mechanism configured to movably hold the floating restricting member relative to the sheet-position adjusting member, the floating restricting member includes:

a sheet contact section that is brought into contact with the sheet when the sheet is pushed from above; and a sheet-floating restricting section to the sheet contact section such that the sheet-floating restricting section and the sheet contact section make a set angle at an edge section and that is brought into contact with the sheet that is floated while the air is blown thereto, thereby restricting a floating position of the sheet, and the holding mechanism is configured to movably hold the floating restricting member in an initial state where the floating restricting member protrudes toward a middle of the sheet-position adjusting members, and in a retracted state where, when the sheet-floating restricting section is pushed above in the initial state, the floating restricting member is rotated, and moved to an inner side of the sheet-position adjusting member.

2. The sheet feeding device according to claim 1, wherein the holding mechanism is configured to movably hold the floating restricting member in a retracted state where, when the sheet contact section is pushed below in the initial state, the floating restricting member is retracted inside the sheet-position adjusting member.

3. The sheet feeding device according to claim 2, wherein the holding mechanism includes pin members at both ends of the floating restricting member with respect to the sheet conveying direction; and a guide member in the sheet-position adjusting member and includes a slit section for rotatably and movably holding the pin member.

4. The sheet feeding device according to claim 2, further comprising at least one of a rotation restricting member configured to restrict a range of a rotary action of the floating restricting member and a horizontal-movement restricting member configured to restrict a range of an action of the floating restricting member along a horizontal plane.

5. The sheet feeding device according to claim 2, further comprising a load unit configured to apply a load to prevent the floating restricting member from being rotated due to the sheet that is brought into contact with the floating restricting member from below.

6. The sheet feeding device according to claim 2, wherein the floating restricting member is provided with one or more elastic members that return the floating restricting member to the initial state.

7. The sheet feeding device according to claim 2, wherein tilted sections are formed on front and rear edge sections of the floating restricting member with respect to the sheet conveying direction and, when the sheet is placed in the sheet conveying direction and is brought into contact with the tilted sections, the tilted sections cause the floating restricting member to be retracted to outside the sheet-position adjusting member.

8. The sheet feeding device according to claim 2, further comprising a unit that moves a position of the floating restricting member relative to the sheet that is placed on the bottom plate.

9. The sheet feeding device according to claim 1, wherein the holding mechanism includes pin members at both ends of the floating restricting member with respect to the sheet conveying direction; and a guide member in the sheet-position adjusting member and includes a slit section for rotatably and movably holding the pin member.

10. The sheet feeding device according to claim 9, further comprising at least one of a rotation restricting member configured to restrict a range of a rotary action of the floating restricting member and a horizontal-movement restricting member that configured to restrict a range of an action of the floating restricting member along a horizontal plane.

11. The sheet feeding device according to claim 9, further comprising a load unit configured to apply a load to prevent the floating restricting member from being rotated due to the sheet that is brought into contact with the floating restricting member from below.

12. The sheet feeding device according to claim 9, wherein the floating restricting member is provided with one or more elastic members that return the floating restricting member to the initial state.

13. The sheet feeding device according to claim 9, wherein tilted sections are formed on front and rear edge sections of the floating restricting member with respect to the sheet conveying direction and, when the sheet is placed in the sheet conveying direction and is brought into contact with the tilted sections, the tilted sections cause the floating restricting member to be retracted to outside the sheet-position adjusting member.

14. The sheet feeding device according to claim 1, further comprising at least one of a rotation restricting member configured to restrict a range of a rotary action of the floating restricting member and a horizontal-movement restricting member configured to restrict a range of an action of the floating restricting member along a horizontal plane.

15. The sheet feeding device according to claim 1, further comprising a load unit configured to apply a load to prevent the floating restricting member from being rotated due to the sheet that is brought into contact with the floating restricting member from below.

16. The sheet feeding device according to claim 1, wherein the floating restricting member is provided with one or more elastic members that return the floating restricting member to the initial state.

17. The sheet feeding device according to claim 1, wherein tilted sections are formed on front and rear edge sections of the floating restricting member with respect to the sheet conveying direction and, when the sheet is placed in the sheet conveying direction and is brought into contact with the tilted sections, the tilted sections cause the floating restricting member to be retracted to outside the sheet-position adjusting member.

18. The sheet feeding device according to claim 1, further comprising a unit that moves a position of the floating restricting member relative to the sheet that is placed on the bottom plate.

19. An image forming apparatus comprising:

the sheet feeding device according to claim 1; and an image forming unit that forms an image on the sheet that is conveyed by the sheet feeding device.

20. An image forming system comprising:

the sheet feeding device according to claim 1; and an image forming apparatus that forms an image on the sheet that is conveyed by the sheet feeding device.

* * * * *